US006283609B1

(12) United States Patent
Parsons et al.

(10) Patent No.: US 6,283,609 B1
(45) Date of Patent: Sep. 4, 2001

(54) TACTICAL FLASHLIGHT

(75) Inventors: Kevin L. Parsons, Appleton, WI (US); Donald A. Keller, Irving; Clay C. Reeves, Dallas, both of TX (US)

(73) Assignee: Armament Systems and Procedures, Inc., Appleton, WI (US)

( * ) Notice: Subject to any disclaimer, the term of this patent is extended or adjusted under 35 U.S.C. 154(b) by 0 days.

(21) Appl. No.: 08/738,858

(22) Filed: Oct. 28, 1996

(51) Int. Cl.[7] ..... F21L 7/00
(52) U.S. Cl. ..... 362/187; 362/205
(58) Field of Search ..... 362/369, 102, 362/205, 206, 207, 187, 188

(56) References Cited

U.S. PATENT DOCUMENTS

| | | | | |
|---|---|---|---|---|
| 1,820,620 | * | 8/1931 | Jones | 362/240 |
| 3,265,880 | * | 8/1966 | Whitman | 362/207 |
| 4,274,130 | * | 6/1981 | Elliott | 362/184 |
| 4,357,648 | * | 11/1982 | Nelson | 362/183 |
| 4,408,263 | * | 10/1983 | Sternlicht | 362/189 |
| 4,441,142 | * | 4/1984 | Garofalo | 362/158 |
| 4,725,932 | * | 2/1988 | Gammache | 362/202 |
| 4,949,231 | * | 8/1990 | Wang et al. | 362/206 |
| 5,036,444 | * | 7/1991 | Hiles | 362/188 |
| 5,117,341 | * | 5/1992 | Huang et al. | 362/184 |
| 5,121,308 | * | 6/1992 | Maglica et al. | 362/187 |
| 5,287,255 | * | 2/1994 | Strodtman | 362/102 |
| 5,309,337 | * | 5/1994 | Groben | 362/206 |
| 5,317,490 | * | 5/1994 | Miller | 362/206 |
| 5,353,208 | * | 10/1994 | Moore | 362/202 |
| 5,400,227 | * | 3/1995 | Maglica et al. | 362/206 |
| 5,463,541 | * | 10/1995 | Greene | 362/369 |
| 5,499,172 | * | 3/1996 | Shiau | 362/187 |
| 5,667,293 | * | 9/1997 | Own | 362/184 |
| 5,765,937 | * | 6/1998 | Shiau | 362/205 |

OTHER PUBLICATIONS

Photographs of the Tac–Star Flashlight.

* cited by examiner

*Primary Examiner*—Sandra O'Shea
*Assistant Examiner*—Peggy A Neils
(74) *Attorney, Agent, or Firm*—Robert F. I. Conte; Lee, Mann, Smith, McWilliams, Sweeney & Ohlson

(57) ABSTRACT

The flashlight of the present invention is comprised generally of a flashlight chassis which houses energy cells, a flashlight head which houses a beam adjustment assembly, and an endcap which houses a switch assembly. The beam adjustment assembly and the switch assembly utilize printed circuit boards to support the lamp bulb and switch, respectively. The beam adjustment assembly mounts inside the flashlight head and can only be accessed and adjusted by removing the outer lens retaining ring that secures the assembly within the head. Once accessed, the bulb support of the assembly can be rotated relative to the reflector of the assembly to adjust the light focal length of the flashlight. The adjustment assembly is also provided with a shock absorber that supports the light bulb. In one embodiment, the endcap is provided with a threads to permit the flashlight to be axially attached to an expandable baton. This embodiment also incorporates a side mounted switch to enhance manipulation and use of the combination flashlight/expandable baton device. In another embodiment, the endcap has an end-mounted switch to permit full extension of the flashlight. In each embodiment, a multi-function, low noise, push-button switch is utilized. The switch mounts on the printed circuit board, and is provided with primary and secondary circuits to guard against switch failure. The switch is protected by a cover integrally formed of an o-ring.

48 Claims, 7 Drawing Sheets

214
214
202
40
320
310
308
302
480
483
482
424
426
402
406
428
404
430
436
432
438
434
450

TACTICAL FLASHLIGHT

BACKGROUND OF INVENTION

1. Field of Invention

This invention is generally related to flashlights and is more specifically directed to flashlights that can be attached to implements such as law enforcement batons or nightsticks. The invention is most specifically directed to a flashlight that incorporates circuit boards as electrical components, an adjustable focus that cannot be inadvertently altered, and a switch that is positioned to enhance ease of use particularly in law enforcement situations.

2. Description of the Prior Art

Flashlights are well known in the prior art and have been heavily utilized in emergency situations and by law enforcement personnel in the execution of their duties. During use, such flashlights may be subjected to harsh environments and treatment, and therefore should be designed to withstand the application of various forces, whether rolling around under the seat of a car or blocking blows from suspects, as well as the presence of debris, including water and mud, that could interfere with the operation of the flashlight. Generally, such flashlights include a housing which is formed of a body section and a head section. The head section typically is disposed to receive a lens, a reflector, and a lamp, all of which are secured in the head by a lens ring that is threadingly engaged with the head section. The body section houses batteries utilized to energize the lamp.

The electrical circuit of such flashlights is typically comprised of a first wire or metallic strip that connects the positive terminal of the battery with the positive lead of the lamp, and a second wire or metallic strip that connects the negative terminal of the battery with the negative lead of the lamp. The second wire may be attached to an electrically conductive spring that contacts the negative terminal of the battery while urging the positive terminal of the battery into contact with the first wire. In some prior art embodiments, the second wire is attached directly to the flashlight housing or barrel such that the circuit is completed utilizing the housing itself as a conductor, the housing also being attached to the conductive spring.

To control operation of the lamp, a switch is disposed within the circuit. There are numerous varieties of switches that are utilized in the prior art to open and close a circuit. These switches are generally either mechanical or electrical. One common variety is a slide switch that mounts on the forward body section of the flashlight and utilizes a metallic strip to bridge a gap created in the wiring on the negative side of the electrical system. The switch includes a slide member that mounts in a slot on the external surface of the body section. The slide member can be used to move the metallic strip between a first "off" position in which the metallic strip is insulated from contact with the negative side of the electrical system and a second "on" position in which the metallic strip bridges the gap in the circuit, closing the circuit to activate the flashlight lamp.

Another type of switch simply replaces the slide switch with a forward mounted, push-button switch that can be activated to open and close a circuit. Push-button switches, whether mechanical or electrical, are well known in the art and are generally characterized by a distinctive "click" as the switch is engaged and disengaged. In the case of mechanical push-button switches, this "click" is generated as metallic parts within the switch strike one another. In other instances, such as in electrical pushbutton switches, the "click" emanates from the depression and release of a spring mechanism or catch mechanism within the switch. In any event, such switches are undesirable because the distinctive "click" could be used by suspects or those under surveillance to identify the presence or location of law enforcement personnel.

Push button switches are also commonly used as "dead man" switches. In law enforcement, it is often desirable to utilize a switch that only maintains electrical contact when the switch is depressed and manually held down by the user. Upon release of the button, the electrical circuit is interrupted. Thus if the flashlight falls from the user's hand, the circuit is broken and the flashlight is extinguished. For example, if a police officer becomes injured or incapacitated in such a way as to drop his or her flashlight, a deadman switch will cause the flashlight to extinguish, preventing a suspect from ascertaining the injured officer's location. Another common use of such a switch is to permit intermittent use of a flashlight, such as for signalling purposes. In any event, like the other prior art push button-type switches, dead man switches are characterized by a distinctive "click" as the switch is engaged and disengaged.

Although push button switches are generally more reliable than slide switches, push button switches are susceptible to damage from exposure to moisture or particulate matter such as dust or dirt. Therefore, push button switches incorporated into flashlights are often covered to inhibit migration of moisture and debris into the switch. The covering is usually some type of thin, resilient membrane such as rubber or the like and may take several different forms. For example, MAGLITE, a well known flashlight manufacturer, provides a bowl shaped cover with a thin lip around the open end of the cover. The cover also has an aperture or slit in the center of the bowl. To "seal" the cover over the switch, the cover is placed over the switch so that the lip is sandwiched between an inner portion and an outer portion of the flashlight. An allen wrench is then inserted through the slit to engage a threaded fastener attaching the inner and outer portions. The threaded fastener is then rotated to draw the inner and outer portions together such that the lip of the switch cover is tightly sandwiched between the inner and outer portions. Clearly, although the outer perimeter of the switch cover is sealed, the slit in the bowl of the switch cover still renders the switch cover penetrable by moisture and debris.

Another type of switch used in the prior art flashlights utilizes the flashlight housing as a portion of the negative side of the electrical circuit. Typically, these types of flashlights require rotation of one portion of the flashlight body relative to another portion of the flashlight body to open and close the circuit. The head of the flashlight must be rotated relative to the body of the flashlight to activate and deactivate the flashlight lamp. In such a configuration, the negative lead from the lamp is attached to the flashlight head, while the negative terminal from the battery is attached to the flashlight body. The body and the head are threadingly engaged to permit rotation of the head relative to the body. When assembled, the head and body are insulated from one another to preclude electrical contact. Only upon additional rotation of the head towards the body is electrical contact between conductive portions of the two sections achieved such that the negative circuit is closed.

In another similar type of switch, a flashlight is provided with an endcap that can be rotated relative to the body of the flashlight to close the negative side of the electrical circuit. The endcap is in electrical contact with the negative terminal of a battery and is threadingly engaged with the flashlight body. However, the endcap is insulated from electrical contact with the body itself such that the conductive portions of the body and endcap are not in contact. Only upon rotation of the endcap relative to the body are the electrically conductive portions of the endcap and body brought together to close the circuit and activate the flashlight lamp. An example of such a flashlight is manufactured by Laser Products, and further includes a mechanical deadman switch positioned on side of the endcap.

Switches such as the above-mentioned push-button type and slide type are typically mounted at the forward end of the flashlight near the head portion of the body. More specifically, such switches at or forward of the center of gravity of the flashlight because the most common activation finger, the thumb, naturally rests at this point. Flashlights are most often supported in the "underhand" position by resting the barrel of the flashlight on the fingers and closing the palm of the hand around the side of the barrel such that the thumb is disposed on the top of the barrel and points forward, away from the user. This position enhances the balance of the flashlight in the fingers and palm of a user's hand while permitting the user to easily activate and deactivate the switch with the forward pointed thumb. With such a grip, the "ready" position of the light is comfortably between the waist and chest.

Law enforcement personnel more commonly support flashlights in the "overhand" position that permits the light to be most comfortably held at shoulder level or higher. Specifically, this position entails resting the barrel of the flashlight in the palm of the hand and closing the fingers around the side and over the top of the barrel. In this position, the thumb is disposed on the bottom of the barrel and points backward, toward the user. With the thumb in this position, a forward mounted switch would be difficult to operate. Therefore, placement of the prior art switches is not conducive to use by law enforcement personnel who are often required to hold the flashlight in a specific "maneuver" position or in combination with other instruments.

One common problem with the push-button type and slide type switches of the prior art is that they are not typically provided with a "back-up" system or method for ensuring that the flashlight will continue to function should a portion of the switch fail. For example, it is typical for the metallic strip of the slide type switch to become loose over time, unintentionally interrupting the electrical contact between the metallic strip and the wires of the circuit. The result of such an interruption is failure of circuit and hence failure of the flashlight. Failure of the flashlight, especially in emergency or law enforcement situations, is undesirable at best and could place the flashlight user in jeopardy.

Notwithstanding the manner is which prior art flashlights are activated, such flashlights are typically pre-focused at the factory to provide a light beam that is a combination of a spot light and a flood light. Spot lights are characterized by a narrow, intense beam of light that projects over a distance, while flood lights are characterized by a broad, diffused beam of light that illuminates the immediate area around the light. The nature of a particular beam of light is determined by the light focal length (LFL), which is the distance between the light bulb filament and the base of the parabolic reflector. The greater the LFL, the more diffused the light beam. In other words, a flood light has a larger LFL than a spot light.

In any event, most prior art flashlights are pre-set at the factory to have a light beam that is a combination flood and spot. The position of the light bulb relative to the reflector is permanently fixed at the factory to achieve this combination. One problem with such flashlights is that the position of the filament from light bulb to light bulb is not exact. Thus the LFL for a flashlight can vary depending on the particular light bulb inserted into the flashlight.

More recent prior art flashlights have been focusable. Focusable flashlights permit the user to select the type of beam to be generated—either flood, spot or a combination—depending on the user's particular requirements. Focusable flashlights are typically adjusted by turning the head of the flashlight relative to the body of the flashlight. The reflector is attached to the head of the flashlight while the light bulb is attached to the body of the flashlight. Since the head of the flashlight is threadingly attached to the body of the flashlight, rotation of the head of the flashlight relative to the body alters the LFL, permitting a user to achieve the desired beam of light. One drawback to a focusable flashlight is that the relative position of the body and the head of the flashlight can be altered inadvertently, especially when the threads attaching the head to the body become worn or loose.

Flashlights used in law enforcement or emergency situations are often subject to harsh environments and treatment. A blow to the outside of a focusable prior art flashlight has a tendency to knock the flashlight out of focus. The same is true for flashlights that may be left to roll around in a vehicle—the head of the flashlight may have a tendency to move relative to the body of the flashlight. Clearly, there are many instances in which a flashlight focusable by rotating the head relative to the body can be inadvertently altered. In such instances, the focus of the flashlight must be re-set each time the flashlight is used, consuming valuable time and frustrating to the user.

Another drawback to prior art flashlights, especially those subject to harsh treatment, is that the flashlights may not sufficiently insulate the lamp bulb from external shocks placed on the flashlight. Flashlight bulbs are generally provided with a positive and negative pin extending from the end of the lamp bulb. In prior art flashlights, typically, the bulb is cantilevered on the two conducting pins of the lamp bulb such that the glass end, the most fragile portion of a lamp bulb, is unsupported. External blows placed on the flashlight or sudden movements of the flashlight can result in damage to an unsupported lamp bulb. This is especially true since the cantilevered nature of the prior art lamp bulbs has a tendency to magnify forces transferred to the glass body of the bulb through the attachment pins.

Based on the prior art flashlights, therefore, it would be desirable to provide a law enforcement flashlight that is reliable while being suited to withstand the rigorous treatment and environments common to law enforcement. As such, not only should the electrical circuit be reliable, but the lamp bulb and lamp switch should be protected from damage as well. In addition, the focus of the flashlight should be adjustable and adaptable to suit the particular situation in which it is utilized, yet should remain tightly focused even when the flashlight is subjected to external forces. The flashlight should be comfortable to hold and easily operable, yet should be configured to minimize revealing the presence or location of the user. Finally, the flashlight should also be adaptable for use with other law enforcement tools, such as an ASP expandable baton.

SUMMARY OF THE INVENTION

Flashlights are often utilized by law enforcement personnel in the execution of their duties. Typically, law enforcement personnel rely on several different instruments in performing these duties. The most notable of these instruments are a firearm, an expandable baton or nightstick, a flashlight, and handcuffs. Although each may be necessary in any given situation, the officer is limited to the number of instruments he or she can safely hold and manipulate at one time. For example, it would be awkward to handle a firearm, a flashlight and an expandable baton all at one time. An officer might be forced to select only two based on his or her best guess of an unknown situation. It would be much more desirable if the officer could have all three items drawn without the need to select between the three.

The subject invention is specifically directed to a flashlight adapted for use by law enforcement personnel. The flashlight includes a rear mounted switch housing that permits operation of the flashlight in the "overhanded" position. The switch may be placed on the outer end of the switch housing or on the side of the switch housing. In either position, the switch is easily activated by the thumb. When provided with a side mounted switch, the flashlight is ideally suited to be attached directly to another law enforcement implement, such as, by way of example, an expandable baton. The lamp assembly of the flashlight provides for adjustment of the light focal length, whereby a precise focus may be maintained. The flashlight assembly includes shock absorbing characteristics to prevent potential malfunction during rigorous use, and is well-sealed to provide good protection against migration of moisture and debris into the functional components of the flashlight. The switch assembly is a silent action push button with a redundant circuit to further safeguard against malfunction. The flashlight assembly of the preferred embodiment incorporates a unique circuit board configuration for positively mounting both the lamp and the switch to provide for better electrical contact.

More specifically, the flashlight of the subject invention provides a circuit that is less likely to be damaged through shock applied to the exterior of the flashlight by incorporating printed circuit boards throughout the flashlight. In addition, the switches incorporated into the flashlight are less likely to be subject to wear than prior art flashlights. Furthermore, the primary switch circuit is provided with an auxiliary circuits in the event of failure of the primary switch circuit. Because the switches are disposed for use with circuit boards as internal electronic components, they operate more quietly than prior art flashlight switches. The flashlight is also provided with a beam adjustment assembly that permits adjustment of the light beam but prevents inadvertent displacement of the lamp bulb relative to the reflector. The beam adjustment assembly further incorporates a shock absorber to prevent damage to the lamp bulb. Finally, the flashlight is adaptable for attachment to expandable batons.

The flashlight of the current invention is comprised generally of a flashlight barrel which houses energy cells, a flashlight head which houses a beam adjustment assembly, and an endcap housing for a switch assembly. The beam adjustment assembly and the switch assembly utilize printed circuit boards to support the lamp bulb and switch, respectively, and provide positive electrical contact between the energy cells and the conductive elements of the flashlight barrel, head and endcap housing.

Specifically, a first circuit board is incorporated in the beam adjustment assembly and a second circuit board is incorporated in the switch assembly. The lamp is attached directly to the first circuit board which is in contact with the positive terminal of the energy cells via a circuit board retaining ring, i.e., the positive terminal of the energy cell bears against the circuit board retaining ring. A push-button switch is attached directly to the second circuit board which is in contact with the negative terminal of the energy cells via a spring which is attached to the second circuit board and bears against the negative terminal of the energy cells. The flashlight barrel is utilized to complete the circuit by providing electrical contact between the first and second circuit boards.

The switch utilized in the circuit is of the pushbutton type, yet is designed to have a virtually silent operation. The switch is provided with pins to permit attachment to a printed circuit board. The switch is also provided with a "dead man" feature, as well as primary and secondary circuits to ensure uninterrupted operation of the flashlight circuit. Finally, the switch is sealed in the flashlight chassis utilizing a unique switch cover that is integrally formed of a bowl shaped section and an o-ring.

The beam adjustment assembly is used to adjust the LFL by moving the lamp relative to the fixed position of a reflector. The beam adjustment assembly is generally comprised of a parabolic reflector, a lamp support base which is threadingly engaged to the reflector, and a lamp attached to the support base. Since the support base is threadingly engaged to the reflector, the position of the support base, and hence the lamp, relative to the reflector can be altered by rotation of the base at the point of attachment to the reflector. To insure that the position of the lamp and reflector relative to one another is precisely maintained during use of the flashlight, the beam adjustment assembly is secured within the head of the flashlight such that the beam can only be adjusted by partial disassembly of the flashlight head. Specifically, the beam adjustment assembly, including the reflector are secured within the head of the flashlight by the lens ring. Upon removal of the lens ring and lens, the beam adjustment assembly can be removed to permit rotation of the lamp support base relative to the reflector. Once the desired LFL is achieved, the beam adjustment assembly is replaced in the head of the flashlight and secured in place by the lens retainer ring.

Another important feature of the flashlight of the invention is that the flashlight is adapted to attach to expandable batons. An expandable baton is generally comprised of a handle section in which is mounted multiple, nested extension sections of decreasing diameter. An internally threaded endcap and a retaining clip are used to secure the nested sections within the handle of the baton. Upon radial rotation of the handle section, the nested sections deploy such that the end of first section seats in the end of a second adjacent section in which the first section is nested. A sharp axial force applied to the outermost baton section is required to collapse such a baton.

As mentioned above, the flashlight of the invention includes an endcap which houses the switch assembly. In one embodiment, the proximal portion of the flashlight endcap is attached to the flashlight chassis while the distal portion of the endcap is provided with an open, internally threaded bore. The flashlight endcap is also provided with a dividing wall that separates the distal portion of the endcap from the proximal portion of the endcap. This configuration permits the flashlight endcap to be attached to an expandable baton in place of the standard baton endcap, such that the flashlight and the baton are coaxial. When so configured, a law enforcement officer is provided with a flashlight and an expandable baton in a single instrument.

Another important feature of the flashlight of the invention is rear, side mounted switch on the body of the flashlight. Most prior art flashlights locate the switch, whether a push-button or slide-type, on the side of the flashlight near the head of the flashlight, i.e., at the flashlight's approximate center of gravity. None of the prior art flashlights provide a rear, side mounted switch that is an electrical, push-button switch with multiple functions. As mentioned above, one feature of the invention is to allow attachment to an expandable baton. When attached to an expandable baton, the center of gravity of the flashlight shifts along the axis of the flashlight toward the baton. Thus, where a prior art flashlight with a forward mounted switch balances comfortably in a user's hand to permit easy manipulation of the switch, that same flashlight would be end heavy when attached to an expandable baton. As a result, the combination of a prior art flashlight with an expandable baton would be difficult to manipulate and would not be comfortably balanced in a user's hand. By providing a rear, side mounted switch, the flashlight of the invention is better disposed for use with expandable batons.

In another embodiment, the flashlight of the invention is provided with an endcap having a rear mounted switch. Such a switch permits full extension of the flashlight during use. To enhance ease of manufacture, as well as versatility, the internal components of the endcap having an end mounted switch are interchangeable with the internal components of endcap having a side mounted switch.

DETAILED DESCRIPTION OF THE PREFERRED EMBODIMENTS

Figure 1:
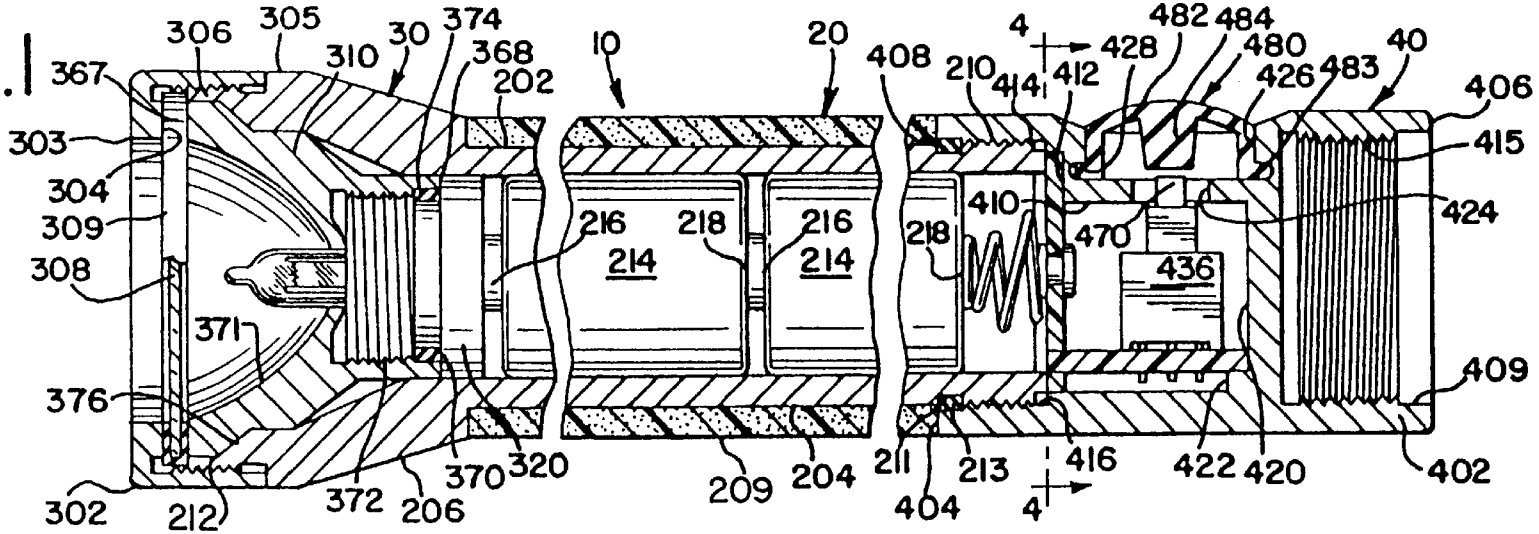
FIG. 1 is a cut-away side view of the flashlight of the invention with a endcap having a side mounted switch assembly.
Figure 2A:
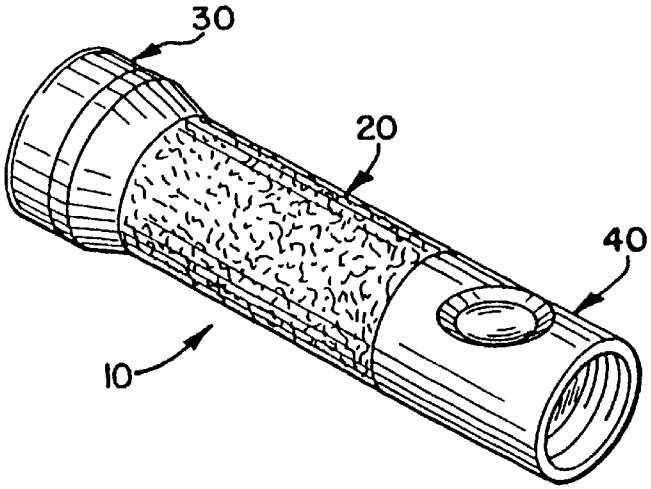
FIG. 2A is a perspective of the flashlight of FIG. 1.
Figures 2B, 2C:
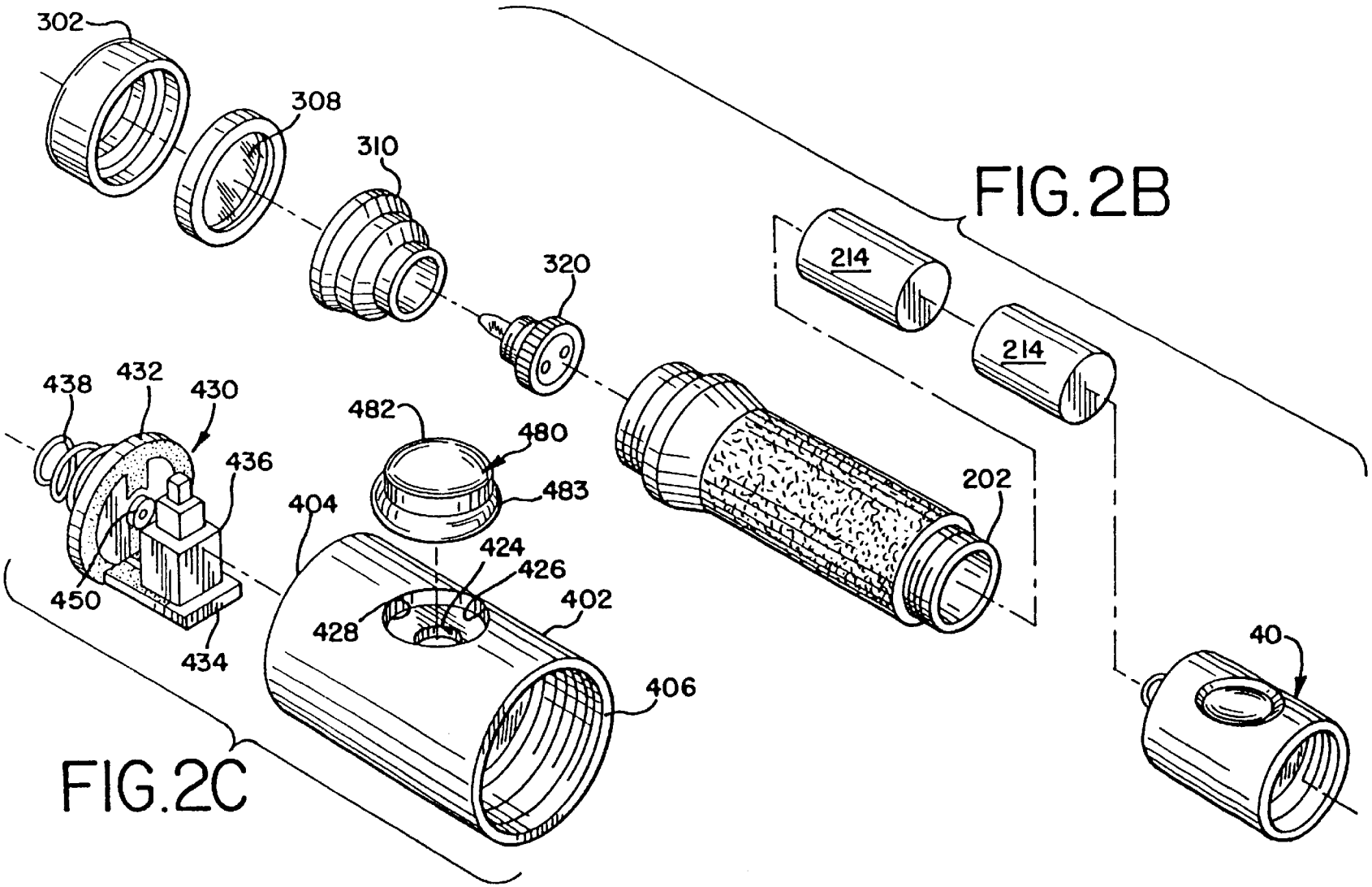
FIG. 2B is an exploded perspective view of the flashlight of FIG. 2A.
FIG. 2C is a partially exploded perspective view of the end cap assembly of FIG. 1.

With reference to FIGS. 1, 2*a*, and 2*b* the flashlight of the present invention is shown and designated as 10. Flashlight 10 is generally comprised of a flashlight body 20, a head 30, and a switch assembly 40. Flashlight body 20 is constructed in part of a battery tube 202 characterized by a barrel section 204 and an integral lamp head section 206 having a flared or bowl shape relative to the diameter of barrel section 204. Barrel section 204 is provided with external threads at 210 while lamp head section 206 is provided with external threads at 211. Adjacent threads 210 is an annular groove 212 for receipt of an o-ring 213. A sleeve 209 is disposed over the unthreaded portion of barrel section 204. Barrel section 204 is disposed for receipt of one or more energy cells 214, each energy cell 214 having a positive contact 216 and a negative contact 218. Energy cells 214 are preferably, but not by way of limitation, 3 volt lithium batteries, although any standard energy cell may be utilized.

Head 30 is comprised of a lens ring 302, a lens 308, a reflector 310 and a lamp assembly 320. Lens ring 302 is defined by a first end 303 and a second end 305. An annular shoulder 304 is disposed at first end 303 about the inner diameter of ring 302. At second end 305, ring 302 is provided with internal threads 306 for engagement with external threads 211 of lamp head section 206 such that lens 308, reflector 310 and lamp assembly 320 are secured within the bowl of lamp head section 206.

Figure 2D:
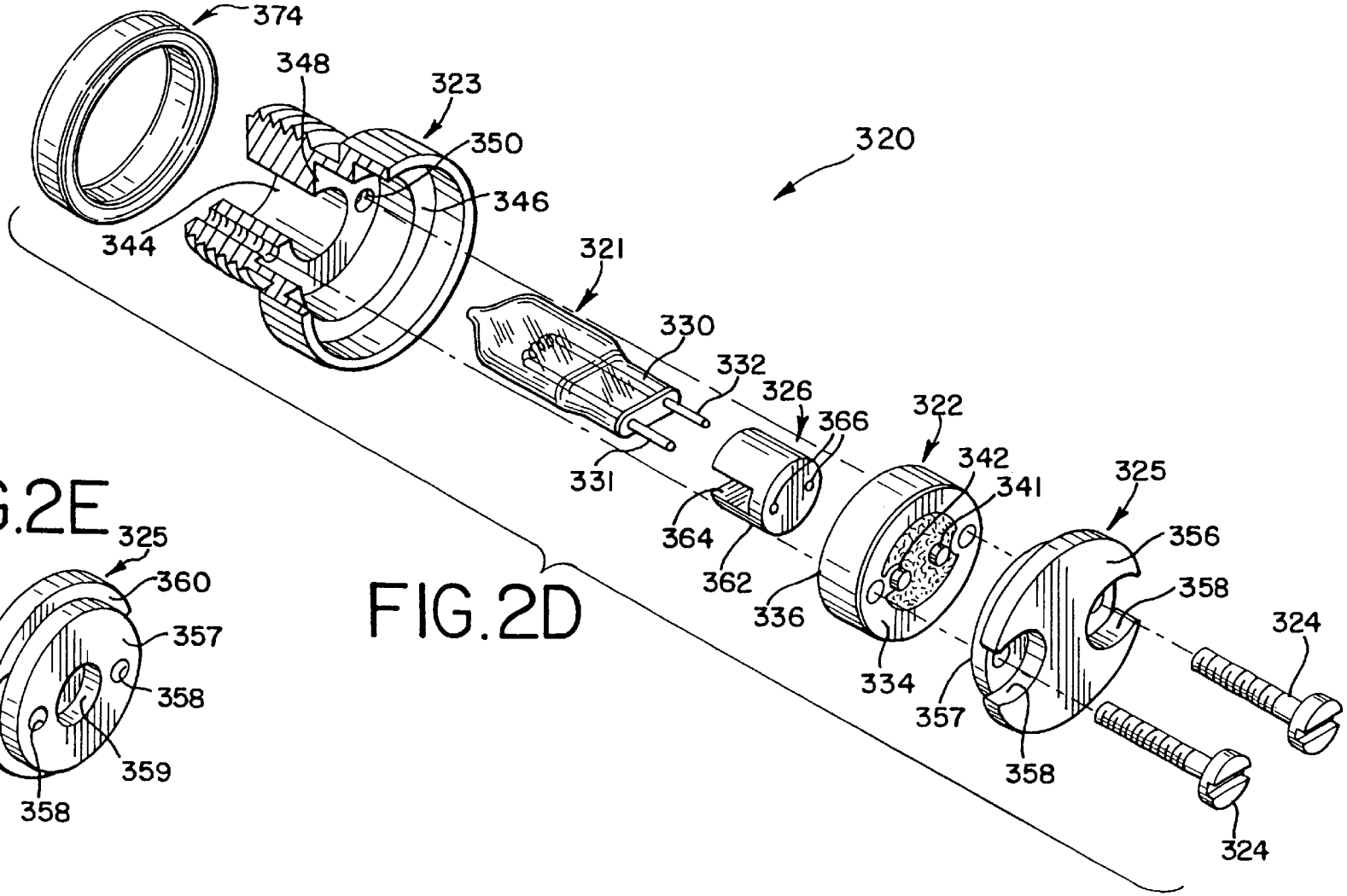
FIG. 2D is an exploded perspective view of the bulb adjustment assembly of the flashlight of the invention.
Figure 2E:
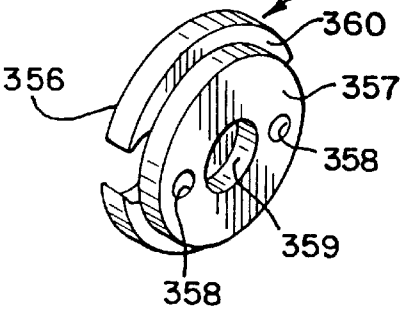
FIG. 2E is a perspective view of the printed circuit board containment plate of the bulb adjustment assembly.
Figure 3:
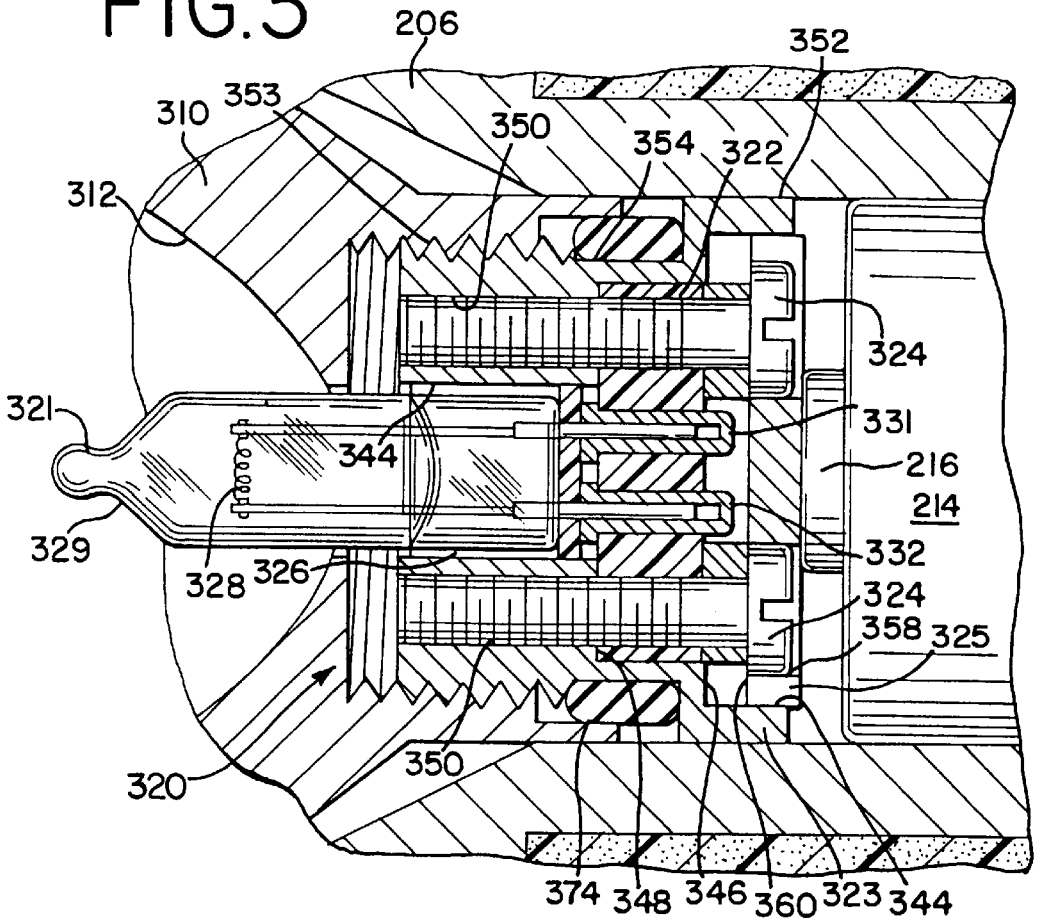
FIG. 3 is a cut-away side view of the bulb adjustment assembly inserted into the flashlight of the invention.
Figure 4:
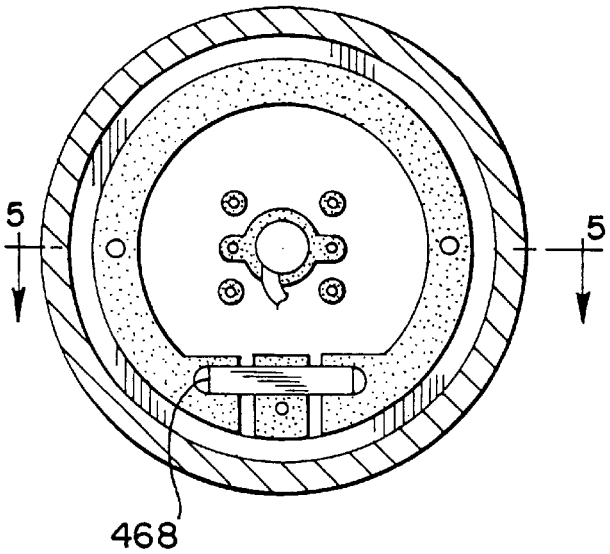
FIG. 4 is a cut-away axial view of the endcap assembly of FIG. 1.

In FIGS. 3 and 2*d*, lamp assembly 320 includes lamp 321, a base or circuit board 322, outer adjustment ring or assembly member 323, non-conductive fasteners 324, board containment plate or outer clamp 325, and bulb shock absorber 326. Outer adjustment ring 323 and board containment plate 325 are formed of electrically conductive material. Lamp 321, which is generally commercially available, comprises a filament 328 disposed within a bulb 329 having a neck section 330 from which extends a positive pin 331 and a negative pin 332. Lamp 321 is mounted on circuit board 322. Lamp bulb 321 is preferably, but not by way of limitation, 6 volt halogen lamp bulb, although any standard lamp bulb may be utilized.

Figure 10:
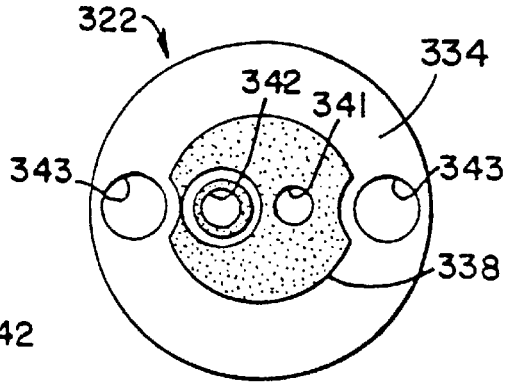
FIG. 10 is a rear axial view of the lamp bulb circuit board.
Figure 9:
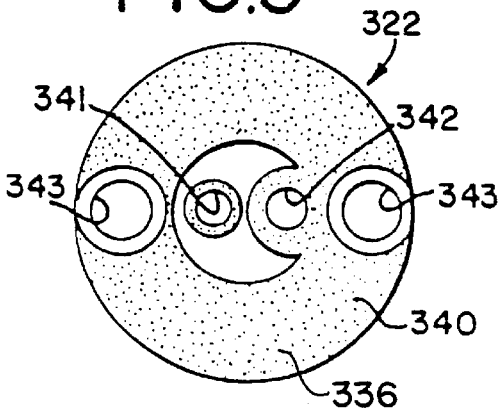
FIG. 9 is a front axial view of the lamp bulb circuit board.

With particular reference to FIGS. 9 and 10, circuit board 322 has a positive side 334 and a negative side 336. Positive side 334 is characterized by a positive electrode 338 and negative side 336 is characterized by a negative electrode 340. A positive pin receptacle 341, a negative pin receptacle 342, and fastener bores 343 extend between side 334 and side 336. Positive pin receptacle 341 is in electrical contact with positive electrode 338 and negative receptacle 342 is in electrical contact with negative electrode 340. Positive and negative pin receptacles 341, 342 are disposed for receipt of positive and negative pins 331, 332 of lamp 321, respectively.

Turning back to FIGS. 3 and 2*d*, outer adjustment ring 323 has a through bore 344 in which is defined a first internal radial shoulder 346 and a second internal radial shoulder 348. Threaded fastener bores 350 are disposed coaxially within shoulder 348. Externally, adjustment ring 323 is provided with a gripping surface 352 and threads 353 with an o-ring groove 354 disposed therebetween. Circuit board 322 seats within through bore 344 such that negative electrode 340 of board 322 abuts second shoulder 348, establishing electrical contact therebetween. In addition, threaded fastener bores 350 of adjustment ring 323 are axially aligned with fastener bores 343 of board 322.

Board containment plate 325 is disposed adjacent the positive side 334 of board 322 to contain board 322 within adjustment ring 323. Containment plate 325 has a first surface 356 and a second surface 357. Countersunk through bores 358 extend from first surface 356 while a countersunk bore 359 extends from second surface 357. Plate 325 also includes an annular shoulder 360 defined between first surface 356 and second surface 357. When disposed to contain board 322, surface 357 of plate 325 abuts positive electrode 338 of board 322, establishing electrical contact therebetween. Countersunk bore 359 is provided to permit positive and negative pin receptacles 341, 342 to extend through board 322 without interference by plate 325. This is especially desirable since negative pin receptacle 342 is part of the flashlight's negative circuit. Countersunk bores 358 axially align with threaded fastener bores 350 of adjustment ring 323 and fastener bores 343 of board 322 to permit non-conductive threaded fasteners 324 to extend through plate 325 and to threadingly engage threaded fastener bores 350 such that board 322 is secured within ring 323. Bores 358 are countersunk to permit electrical contact between first surface 356 of plate 325 and positive terminal 216 of energy cell 214 without interference by connectors 324. Those skilled in the art will understand that the diameter of second surface 357 of plate 325 is preferably smaller than the diameter defining first shoulder 346 of ring 323 such that plate 325 and ring 323 are not in electrical contact.

As mentioned above, one important feature of the present invention is bulb shock absorber 326. Shock absorber 326 comprises an annular plug 362 having an axial slot 364 and through bores 366 extending from the base of slot 364. Shock absorber 326 is disposed for receipt of lamp 321. Specifically, the narrow neck 330 of lamp 321 seats within slot 364 while the positive and negative pins 331, 332 of lamp 321 extend through bores 366. When lamp 321 is mounted in board 322 secured within ring 323, shock absorber 326 seats within bore 344 of ring 323. Shock absorber 326 is preferably formed of a high heat material.

As shown in FIG. 1, lamp adjustment assembly 320 is threadingly engaged to reflector 310. The reflector 310 is provided with a cylindrical socket member having inner peripheral female threads to mate with the outer peripheral threads of ring 323. When so joined, electrical contact is established between adjustment ring 323 is and reflector 310. Reflector 310 is provided with a first end 367 and a second end 368. A through bore 370 extends from second end 368 and intersects the base of a parabola 371 extending from first end 367. Through bore 370 includes internal threads 372 that are disposed for engagement with external threads 353 of lamp adjustment assembly 320 (See FIG. 3). An o-ring or friction member 374 is mounted within groove 354 to prevent inadvertent movement of lamp adjustment assembly 320 relative to reflector 310. As explained above, reflector 310 mounts within the bowl of lamp head section 206. Specifically, the outer surface of reflector 310 seats within head 206 such that electrical contact is established therebetween such as at 376.

Lens 308 rests against first end 367 of reflector 310. In the preferred embodiment, a gasket 309 is disposed around lens 310 to protect lens 310 and to seal head 206. Lens ring 302 fits around gasket 309 and lens 308 such that shoulder 304 abuts gasket 309. Preferably, lens 310 is further protected by providing shoulder 304 with a comparatively large axial thickness such that lens 310 is set inward from first end 303 of ring 302. As explained above, the second end 305 of ring 302 is provided with internal threads 306 for engagement with external threads 211 of lamp head section 206. When ring 302 is tightened onto head section 206, lens 308, reflector 310 and lamp assembly 320 are secured within the bowl of lamp head section 206.

Figure 5:
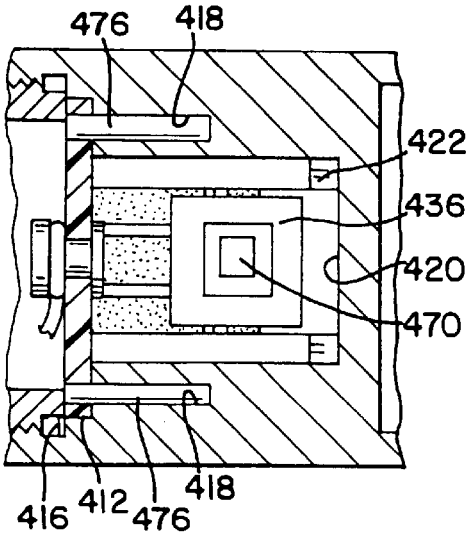
FIG. 5 is a cut-away top view of the endcap assembly of FIG. 1.

Turning now to switch assembly 40 as is best shown in FIGS. 1 and 2*c*, the assembly includes an endcap or closure 402 having a first end 404 and a second end 406. A first axial bore 408 extends from first end 404 and a second axial bore 409 extends from second end 406. First axial bore 408 is internally threaded at 414 while second axial bore 409 is internally threaded at 415. Bore 408 extends to intersect a cavity 410 defined within endcap 402 (FIG. 5). An annular shoulder 412 is provided at the intersection of cavity 410 and bore 408. Extending radially from shoulder 412 are fastener bores 418 (FIG. 5). First axial bore 408 may further include an annular channel 416 between threads 414 and shoulder 412.

Cavity 410 is separated from second axial bore 409 by a dividing wall 420, and further includes a step 422 at wall 420. An aperture 424 joins cavity 410 with a countersunk radial bore 426 provided in the outer surface of endcap 402. At the base of countersunk bore 426 is an o-ring groove or continous channel 428.

Figure 8:
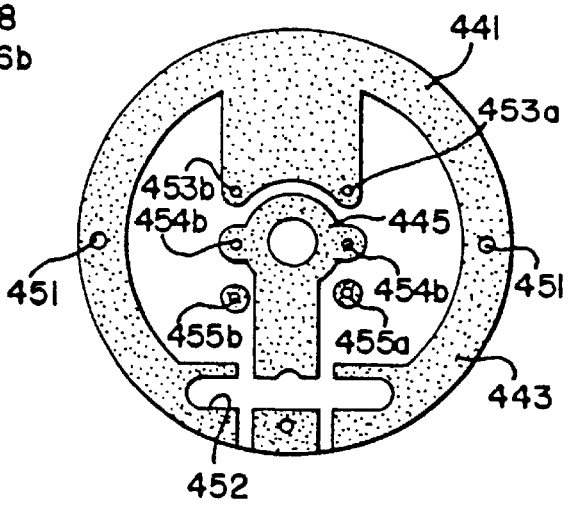
FIG. 8 is a rear axial view of the first circuit board of the switch circuit assembly.

Disposed within endcap 402 is a switch circuit assembly 430 (FIG. 6) which comprises a first circuit board or base 432, a second circuit board or secondary base member 434, a switch 436, and a spring 438 the spring 438 functions are a conductive element. With reference to FIGS. 7 and 8, first circuit board 432 has a first side 440 and a second side 441. Defined on first side 440 is a first electrode 442 and a second electrode 443. Defined on second side 441 is a third electrode 445 and a fourth electrode 446. A central bore 448 extends between first side 440 and second side 441 for receipt of an electrically conductive threaded nipple 450 (FIG. 6) that is in electrical contact with both first electrode 442 and third electrode 445. Spring 438 (FIG. 6) attaches to nipple 450 and is therefore in electrical contact with third electrode 445. Fastener holes 451 and a slot 452 are disposed about the peripheral edge of board 432. Fastener holes 451 are electrically conductive such that second and fourth electrodes 443, 446 are in electrical contact. Finally, electrically conductive pin holes 453, 454, and 455 are aligned about central bore 448. Pin holes 454 are in electrical contact with first and third electrodes 442, 445. Likewise, pin holes 453 are in electrical contact with second and forth electrodes 443, 446.

Second board 434, which has a first side 458 and a second side 459, is similarly provided with a number of electrodes. Specifically, board 434 has a first electrode 460, a second electrode 462 and a third electrode 463. Board 434 also has electrically conductive pin holes 464, 465, and 466 that are aligned about the major axis of board 434. Pin hole 464*a* is in electrical contact with first electrode 460, pin hole 464*b* is in electrical contact with second electrode 462, and pin holes 465 are in electrical contact with third electrode 463.

Those skilled in the art will understand that the second side 459 of board 434 may be similarly configured as first side 458 to aid in the assembly of switch circuit assembly 430. Board 434 further defines a tab 468 which is disposed to seat in slot 452 of first board 432 to permit first board 432 to be joined with second board 434. When first board 432 is joined with second board 434, third electrode 445 of first board 432 is in electrical contact with third electrode 463 of second board 434, and fourth electrode 446 of first board 432 is in electrical contact with first and second electrodes 460, 462 of second board 434.

Figure 6:
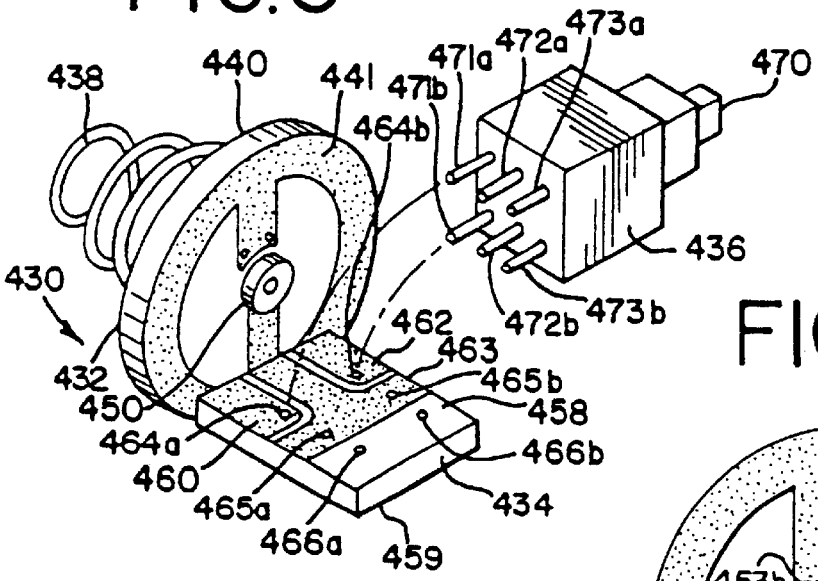
FIG. 6 is a partially exploded perspective view of the side mounted switch circuit assembly of FIG. 1.
Figure 7:
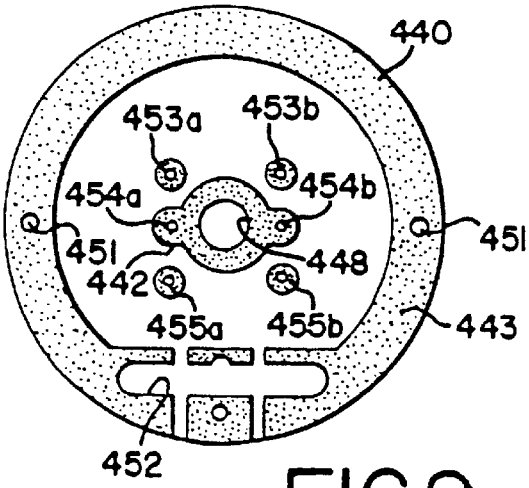
FIG. 7, is a front axial view of the first circuit board of the switch circuit assembly.

As is best seen in FIG. 6, switch 436, which is generally commercially available, is of the push-button type and is provided with a plunger 470, and a number of electrical attachment pins 471, 472, 473, which are disposed for receipt in holes 464, 465, 466 of second board 434. The plunger function or a switching element in this switch assembly those skilled in the art will understand that switch 436 is generally designed for internal attachment to circuit boards used in electronic devices that are significantly free of moisture and debris. Such switches are typically characterized by very quiet operation due to their size and construction. Another feature of such switches is that they are characterized by at least two plunger positions. In a first plunger position, the switch is open, while in a second plunger position, in which the plunger is depressed, the switch is closed. Furthermore, when the plunger is only partially depressed, such switches typically permit electrical contact. Still yet another characteristic of such switches is that they are provided with dual pins for each plunger position.

When switch 436 is attached to board 434, plunger 470 can be manipulated to establish electrical contact between first, second and third electrodes 460, 462, 463 of second board 434. Specifically, when plunger 470 is depressed, a closed electrical circuit is established between first, second and third electrodes 460, 462, 463 of second board 434. As such, an electrical current applied to spring 438 passes through nipple 450, into third electrode 445 of first board 432, into third electrode 463 of second board 434, into switch 436 via pins 472, out of switch 436 via pins 471, into first and second electrodes 460, 462 of second board 434 and into fourth electrode 446 of first board 432. Furthermore, since fastener holes 451 establish electrical contact between fourth electrode 446 and second electrode 443 of first board 432, second electrode 443 is also included in the closed circuit.

Figure 11:
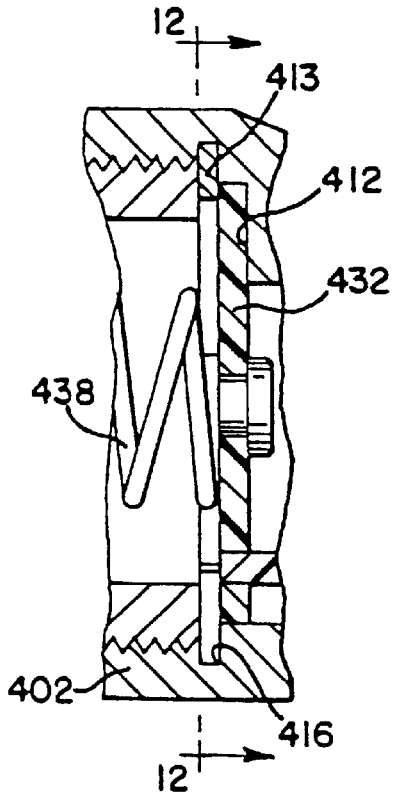
FIG. 11 is a cut-away side view of a retaining ring securing the switch circuit assembly in an endcap.
Figure 12:
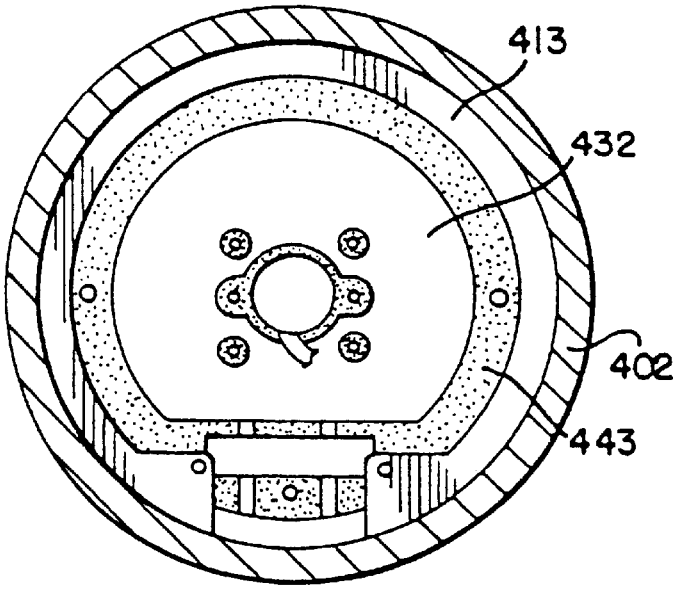
FIG. 12 is a cut-away front axial view of FIG. 11.

Turning back to FIGS. 1 and 2*c*, switch circuit assembly 430 is disposed within endcap 402 such that second circuit board 434 rests on step 422 and first circuit board 432 abuts annular shoulder 412. In the preferred embodiment, the height of step 422 is large enough to preclude switch pins 471, 472, 473 extending through board 434 from contacting endcap 402. When seated in this manner, plunger 470 is axially aligned with aperture 424, fastener holes 451 of first board 432 are axially aligned with fastener bores 418 of endcap 402, and spring 438 is axially aligned with first axial bore 408 of endcap 402. Additionally, when board 432 is seated against shoulder 412, fourth electrode 446 of board 432 overlays shoulder 412 such that shoulder 412 and fourth electrode 446 are in electrical contact. In one embodiment, electrically conductive, press fit pins 476 may be disposed through fastener holes 451 and into fastener bores 418 to retain board 432 against shoulder 412. In another embodiment (FIGS. 11 and 12), an electrically conductive annular retaining ring 413 may be disposed in annular channel 416 to retain board 432 against shoulder 412. Retaining ring 413 overlays second electrode 443 of board 432 to provide electrical contact between endcap 402 and second electrode 443.

Another important feature of switch assembly 40 is switch cover or switch activation element 480 which protects switch circuit assembly 430 from moisture and debris. Switch cover 480 is integrally formed of a bowl shaped section 482, an o-ring 483 disposed about the open end of bowl shaped section 482, and a stem 484 attached to the interior of bowl section 482 and axially aligned therewith. Switch cover 480 is disposed within bore 426 and above plunger 470 of switch 436, such that o-ring 483 sealingly seats in o-ring groove 428 and stem 484 is axially aligned above plunger 470. Stem 484 functions both to provide support to bowl section 482 and to engage plunger 470 when switch cover 480 is depressed. Switch cover 480 may be formed of any resilient material, such as, by way of example, rubber.

With reference to FIG. 1, switch assembly 40 is secured to barrel section 204 by way of mating threads 210 and 414 such that o-ring 213 sealingly engages bore 408. In the preferred embodiment, sleeve 209, when disposed over barrel section 204, is of the same outer diameter as endcap 402 such that sleeve 209 provides an additional seal against the migration of moisture and debris between switch assembly 40 and barrel section 204. In the preferred embodiment, cover 209 is formed of a foamed vinyl.

The electrical circuit of the flashlight of the preferred embodiment will now be summarized. Positive terminal 216 of fuel cell 214 bears against circuit board containment plate 325 which is contact with the positive pin 331 of lamp 321 via positive electrode 338 of circuit board 322. Negative pin 332 of lamp 321 is in contact with negative electrode 340 of circuit board 322. Board 322 is urged against shoulder 348 of adjustment ring 323 such that adjustment ring 323 and negative electrode 340 are in contact. Adjustment ring 323 is threadingly engaged with reflector 310 to provide electrical contact therebetween. Reflector 310 seats within lamp head section 206 at 376. Lamp head section 206 and barrel section 204 are integrally formed and provide an electrical current path to endcap 402, which is in electrical contact with section 204 by way of engagement threads 414. Endcap 402 includes an annular shoulder 412 against which first circuit board 432 abuts. When so disposed, the fourth electrode 446 of circuit board 432 is in contact with shoulder 412. Second circuit board 434 is attached to first circuit board 432 such that fourth electrode 446 is in contact with first and second electrodes 460, 462 of board 434. Switch 436 is attached to board 434 and, when closed, provides an electrical path between first and second electrodes 460, 462 of board 434 and third electrode 463 of board 434. Third electrode 463 is in contact with third electrode 445 of first board 432. Third electrode 445 of board 432 is in contact with nipple 450 mounted within board 432. Attached to nipple 450 is spring 438 which bears against the negative terminal 218 of energy cell 214, thus completing the circuit. It should also be noted that the threaded end of barrel section 204 bears against second electrode 443 of first circuit board 432, providing additional electrical contact between barrel section 204 and switch circuit assembly 430.

Those skilled in the art will understand that those components of flashlight 10 which are utilized to conduct an electric current are formed of any electrically conductive material such as by way of example but not limitation, aluminum.

Figure 14:
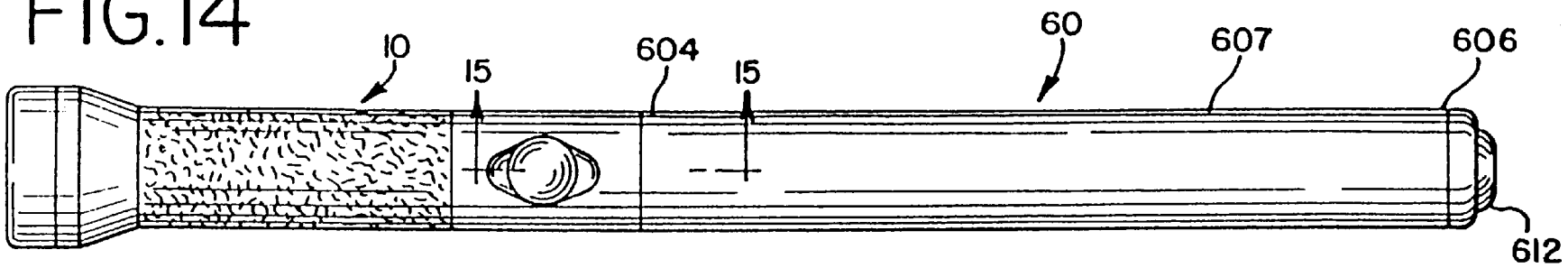
FIG. 14 is a side view of the flashlight of FIG. 1 attached to an expandable baton.
Figure 15:
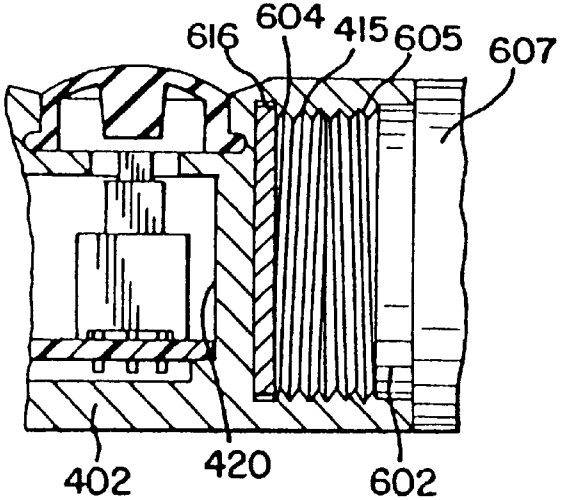
FIG. 15 is a cut-away side view of the joint between the flashlight and baton of FIG. 14.

As mentioned above, endcap 402 is also provided with a socket having internal threads 415 disposed within second bore 409. This end of the endcap 402 functions as an adapter for securing the flashlight to other implements. This configuration permits attachment of other instruments, such as expandable batons, nightsticks or firearms. The instruments are generally provided with external threading to mate with the internal threads of the endcap. With reference to FIGS. 14 and 15, the flashlight 10 of the current invention is shown attached to an expandable baton 60. Expandable baton 60 includes a handle 602 having a first end 604 and a second end 606. First end 604 is provided with external threads 605, while a handle cover 607 is disposed around the unthreaded portions of handle 602. Mounted within handle 602 are multiple, nested extension sections 608, 610 of decreasing diameter. An enlarged tip 612 may be attached to the end of the outermost extension section 610. In the extended position, section 608 seats within second end 606 of handle section 602 and section 610 seats within the distal end of section 608. In the retracted position (FIG. 14), sections 608 and 610 are retained within handle 602 by a retaining clip (not shown) 614. Specifically, the retaining clip mounts on retaining clip plate 616 which abuts first end 604 of handle 602 such that the retaining clip 614 extends into the interior of handle 602. Retaining clip plate 616 is generally secured to handle section 602 by an endcap (not shown) threadingly engaged to external threads 605.

As shown in FIG. 15, internal threads 415 of endcap 402 are disposed for engagement with external threads 605 of baton 60 such that flashlight 10 and baton 60 may be joined together. Retaining clip plate 616 abuts dividing wall 420 and seats against first end 604 of handle 602 such the retaining clip 614 extends into the interior of handle 602. In a preferred embodiment, flashlight 10 is of the same outer diameter as baton 60 such that a smooth, continuous surface is formed between flashlight 10 and baton 60.

Figure 16:
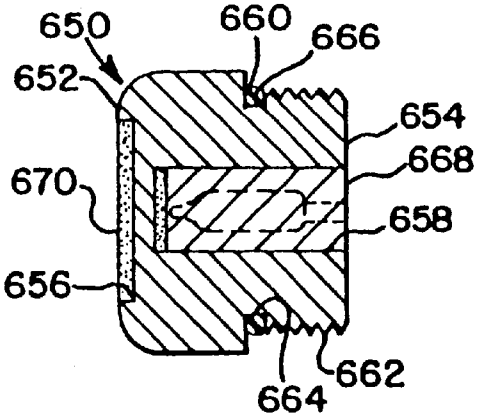
FIG. 16 is a cut-away side view of a lamp storage plug.

When endcap 402 is not attached to other instruments, a plug 650 (FIG. 16) is provided to mount within second bore 409 of endcap 402. Plug 650 is defined by a first end 652 and a second end 654. A shallow first bore 656 is provided in first end 652, while a second bore 658 extends axially from second end 654. The external surface of plug 650 has an annular shoulder 660 and threads 662, with an annular groove 664 disposed therebetween. An o-ring 666 mounts within groove 664, while a sleeve 668 lines the interior of second bore 658. An identification plate 670 mounts within first bore 656 such that plate 670 is flush with the surface of plug 650. When plug 650 is mounted within second bore 409 of endcap 402, sleeve lined second bore 658 may be utilized to store a replacement light bulb 321. Those skilled in the art will understand that sleeve 668 is provided to cushion bulb 321 when disposed within bore 658, and as such, may be formed of any suitable material, such, as by way of example only, foam, rubber, or other resilient or shock absorbing material.

Figure 13:
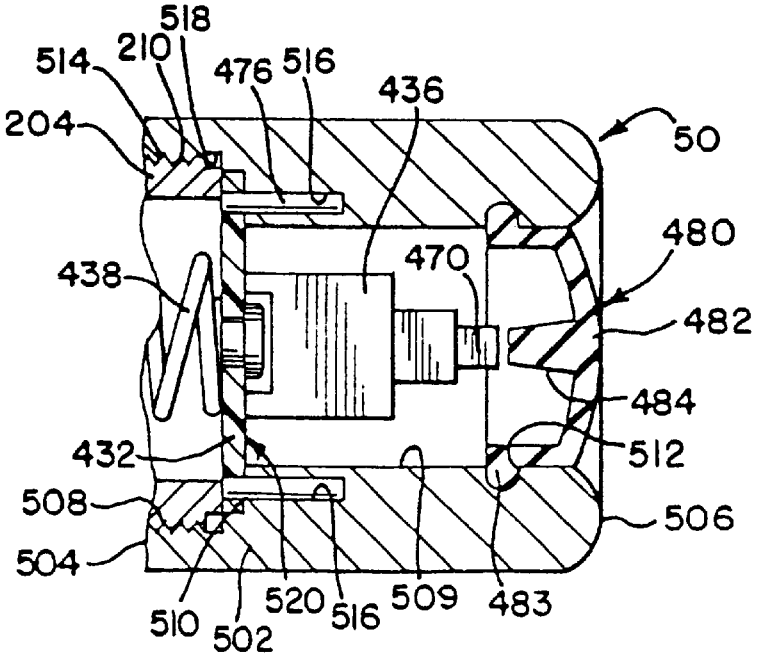
FIG. 13 is a cut-away side view of the end mounted switch assembly.

FIG. 13 illustrates another embodiment of flashlight 10 in which side mounted switch assembly 40 is replaced with rear mounted switch assembly 50. Switch assembly 50 includes an endcap 502 having a first end 504 and a second end 506. A first bore 508 extends axially from first end 504 and intersects a second bore 509 which extends axially from second end 506. An annular shoulder 510 is defined at the intersection of first and second bores 508, 509. An o-ring groove 512 is provided around the inner periphery of second bore 509 adjacent second end 506. Threads 514 are provided around the inner periphery of first bore 508. Extending radially from shoulder 510 are fastener bores 516. First axial bore 508 may further include an annular channel 518 between threads 514 and shoulder 510.

Mounted within endcap 502 is switch circuit assembly 520 which generally comprises a circuit board 432 to which is attached a switch 436 and a spring 438. With reference to FIGS. 6, 7, and 8, spring 438 is mounted in the manner shown and described above. Board 432, which is used to assemble switch circuit assembly 430, may also be used to assemble switch circuit assembly 520 by utilizing electrically conductive pin holes 453, 454, 455. Specifically, the electrical attachment pins 471, 472, 473 of switch 436 are received in pin holes 453, 454, 455. When switch 436 is attached to board 432, plunger 470 can be manipulated to establish electrical contact between first and third electrodes 442, 445 and second and fourth electrodes 443, 446. Specifically, when plunger 470 is depressed, a closed electrical circuit is established between the electrodes of board 432. As such, an electrical current applied to spring 438 passes through nipple 450, into third electrode 445, into switch 436 via pins 472, out of switch 436 via pins 471, and into fourth electrode 446. Furthermore, since fastener holes 451 establish electrical contact between fourth electrode 446 and second electrode 443, second electrode 443 is also included in the closed circuit.

Turning back to FIG. 13, switch circuit assembly 520 is axially disposed within endcap 502 such that board 432 abuts shoulder 510 and switch 436 extends into second bore 509. Switch circuit assembly 520 may be attached to endcap 502 utilizing either roll pins 476 inserted through fastener holes 451 and into fastener bores 516 or retaining ring 413 inserted within annular channel 518. In any event, when board 432 is seated against shoulder 510, fourth electrode 446 overlays shoulder 510 such that shoulder 510 and fourth electrode 446 are in electrical contact.

Switch cover 480 is disposed within bore 509 such that o-ring 483 sealingly seats in o-ring groove 512 and stem 484 extends into bore 509 toward plunger 470. Switch assembly 50 is secured to barrel section 204 by way of mating threads 210 and 514. When secured in this manner, flashlight 10 is provided with an end mounted operation switch that is sealed within the interior of flashlight 10.

One important feature of end mounted switch assembly 50 is its interchangeability with side mounted switch assembly 40, from both a manufacturing perspective and a user's perspective. During manufacture, the only additional element of assembly 50 that is not utilized in assembly 40 is endcap 502. Assembly 50 utilizes each of the other components of assembly 40 except the additional circuit board 434. Those skilled in the art will appreciate that such a configuration lowers both cost and time of manufacture. End mounted switch assembly 50 also adds an additional degree of flexibility to flashlight 10 through the interchangeability of switch assemblies 40 and 50. A user can easily reconfigure a flashlight 10 disposed for mounting on an accessory to a flashlight 10 with an end mounted activation switch by simply unscrewing one endcap and replacing it with the other endcap. The electrical path through end mounted switch assembly 50 is substantially the same as described above for flashlight 10 configured with side mounted switch assembly 40. Specifically, endcap 502, which is attached to barrel section 204, is in electrical contact with barrel section 204 by way of engagement threads 514. Endcap 502 includes an annular shoulder 510 against which first circuit board 432 abuts. When so disposed, the fourth electrode 446 of circuit board 432 is in contact with shoulder 510. Switch 436 is attached to board 432 and, when closed, provides an electrical path between fourth electrode 446 and third electrode 445. Third electrode 445 is in contact with nipple 450 mounted within board 432. Attached to nipple 450 is spring 438 which bears against the negative terminal 218 of energy cell 214, thus completing the circuit. It should also be noted that the threaded end of barrel section 204 bears against second electrode 443 of first circuit board 432, providing additional electrical contact between barrel section 204 and switch circuit assembly 520.

The above-described flashlight provides an electrical circuit that is less subject to wear and shock than prior art flashlights. This is accomplished by incorporating one or more printed circuit boards. The benefits of such board include the limited number of moving parts that could be subjected to wear and shock. In addition, the printed circuit boards function as a means for dissipating shock to individual electric components such as the switch and the lamp bulb. Such components are typically the most fragile elements of a flashlight assembly. The circuit boards also permit enhanced electrical contact throughout the circuit. For example, by incorporating a wide electrode that is in electrical contact with the entire surface area of a shoulder or other component feature, there is less chance that the circuit will be interrupted. On the other hand if a wire or metallic strip were used to establish a discrete contact point, as is done in prior art flashlights, damage to that discrete point could cause the entire circuit to be interrupted. Thus, the circuit boards of the invention permit a much greater contact area, enhancing the durability of the flashlight.

Another unique feature of the flashlight is the lamp adjustment assembly. The assembly is positioned interior of the flashlight and can only be altered by partially disassembling the head of the flashlight. As described, the assembly not only permits adjustment of the lamp bulb relative to the reflector, but also utilizes the contact between the two components to facilitate the electric circuit between the positive terminal of the battery and the flashlight barrel.

Several unique features of the flashlight are also found in the switch assemblies. Whether side mounted or rear mounted, the assemblies provide nearly silent, push button switches at the end of the flashlight, and the switches are multi-functional, having both an intermittent activation position, i.e. a deadman switch, and a continuous activation position.

The switches are further protected by a unique switch cover that is integrally formed of an o-ring to enhance sealing of the switch compartment.

The side mounted switch assembly additionally provides the feature of permitting attachment of the flashlight to an additional accessory, such as an expandable baton. The unique construction of the flashlight is even more desirable when used in combination with such batons because expandable batons typically are subjected to sharp blows, especially as the baton sections are being collapsed back into the baton handle. When not attached to a baton, the open end of the switch assembly can be used to store additional lamp bulbs by attaching an end plug over the open end.

The interchangeability the side mounted and end mounted switch assemblies is also unique, permitting a user to configure the flashlight as desired, without greatly increasing the cost of manufacture of the assemblies to the interchangeability of the internal components of the switch assemblies.

While certain features and embodiments of the invention have been described in detail herein, it will be readily understood that the invention encompasses all modifications and enhancements within the scope and spirit of the following claims.

What is claimed is:

1. A lamp assembly for a portable light, comprising:

a base for supporting a light bulb;

a light bulb having an outer tip and a connector end, and having a filament intermediate the outer tip and the connector end, the light bulb removably mounted in the base;

an assembly member attached to the base and enveloping the a portion of the light bulb between the connector end and the filament;

a reflector adjustably mounted on the assembly member and enveloping the light bulb, whereby the position of the reflector may be adjusted relative to the light bulb; and a resilient member positioned between the light bulb and the base for securing the light bulb in a substantially fixed position relative to the base.

2. A lamp assembly for a portable light, comprising:

a base for supporting a light bulb;

a light bulb having an outer tip and a connector end, and having a filament intermediate the outer tip and the connector end, the light bulb removably mounted in the base;

an assembly member attached to the base and enveloping the a portion of the light bulb between the connector end and the filament;

a reflector adjustably mounted on the assembly member and enveloping the light bulb, whereby the position of the reflector may be adjusted relative to the light bulb; and wherein said base is a printed circuit board; and an outer clamp, with the printed circuit board mounted between the outer clamp and the assembly member, and fasteners for securing the outer clamp to the assembly member.

3. The lamp assembly of claim 2, wherein said printed circuit board is sandwiched between the assembly member and the outer clamp.

4. The lamp assembly of claim 2, the printed circuit board including a positive conductor and a negative conductor in communication with the connector end of the light bulb, the clamp in direct communication with one of said conductors and the assembly member in direct communication with the other of said conductors, wherein said clamp and said assembly member provide conductors for the lamp assembly.

5. The lamp assembly of claim 4, wherein said clamp is electrically insulated from said assembly member.

6. The lamp assembly of claim 5, wherein said fasteners are non-conductive.

7. The lamp assembly of claim 4, further including a barrel for housing the lamp assembly, the barrel extending outwardly from the clamp for accommodating a power source, wherein the power source has a positive power terminus and a negative power terminus, the clamp in direct communication with one power terminus and the barrel in communication with the other power terminus and said assembly member.

8. The lamp assembly of claim 7, wherein said power source further comprises a dry cell battery.

9. A base for supporting a light bulb;

a light bulb having an outer tip and a connector end, and having a filament intermediate the outer tip and the connector end, the light bulb removably mounted in the base;

an assembly member attached to the base and enveloping the a portion of the light bulb between the connector end and the filament;

a reflector adjustably mounted on the assembly member and enveloping the light bulb, whereby the position of the reflector may be adjusted relative to the light bulb; and the assembly member of cylindrical cross-section and having outer peripheral male threads for defining a pin member with a longitudinal axis, and the reflector having a base with a cylindrical socket member having inner peripheral female threads mated with said male threads, wherein said reflector may be axially adjusted relative to the pin axis by rotating the reflector relative to the assembly member.

10. The lamp assembly of claim 9, the light bulb adapted for mounting along the pin axis of the assembly member.

11. The lamp assembly of claim 10, the reflector comprising a parabolic reflector enveloping the light bulb.

12. The lamp assembly of claim 11, wherein the reflector has a focal point and wherein the reflector may be selectively axially adjusted along the pin axis to position the reflector focal point in alignment with the filament of the light bulb.

13. The lamp assembly of claim 9, the friction member comprising a resilient element positioned between the male and female threads, whereby the threads are self-locking.

14. The lamp assembly of claim 13, wherein said male thread includes a peripheral groove for receiving the resilient element and wherein said resilient element is a continuous ring.

15. The lamp assembly of claim 14, wherein said resilient ring provides a seal for defining a moisture barrier between the male and female threads.

16. The lamp assembly of claim 13, wherein said female thread includes a peripheral channel for receiving the resilient element.

17. The lamp assembly of claim 14, wherein said ring is of an oval cross-section.

18. The lamp assembly of claim 1, wherein said resilient member comprises a removable sleeve slidable over the connector end of the bulb.

19. The lamp assembly of claim 1, wherein said resilient member is non-conductive.

20. The lamp assembly of claim 1, wherein said resilient member is adapted for fitting snugly between the light bulb and the assembly member.

21. A flashlight assembly of the type having an elongated barrel having opposite ends for housing a dry-cell battery power source, a lamp assembly and a switching circuit for selectively electrically connecting and disconnecting the lamp assembly to the power source, the lamp assembly being mounted in one end of the barrel and the battery power source being mounted in the barrel between the lamp assembly and the opposite end of the barrel, the flashlight further comprising:

a. a closure for the opposite end of the barrel, the closure defining a switch housing;

b. a switch assembly in the switch housing;

c. a conductive element associated with the switch housing and adapted for electrically connecting the battery power source to the switch assembly;

d. a switching element in the switch assembly adapted for selective movement between an on position placing the switching element in electrical contact with the conductive element and an off position placing the switching element in an open, non-contacting position with the conductive element; and e. a first printed circuit board to which the conductive element is mounted, the conductive element positioned between the battery source and the first printed circuit board.

22. The flashlight assembly of claim 21, wherein said switch assembly is mounted directly on the printed circuit board.

23. The flashlight assembly of claim 21, further including a secondary base member mounted on the base and wherein the switch assembly is mounted directly on the secondary base member.

24. The flashlight assembly of claim 23, wherein said secondary base member is a printed circuit board.

25. The flashlight assembly of claim 23, wherein said base is disposed in a diametric plane of the barrel, and wherein said secondary base member is positioned substantially orthogonally to the base.

26. The flashlight assembly of claim 21, wherein the switch assembly includes a switch activation element extending radially outward from the switch housing defining a side switch.

27. The flashlight assembly of claim 21, wherein the switch assembly includes a switch activation element extending axially outward from the switch housing for defining an end switch.

28. The flashlight assembly of claim 21, wherein said closure is selectively removable from the barrel.

29. The flashlight assembly of claim 28, said barrel further including outer peripheral threads on the opposite end and said closure including inner peripheral threads whereby the closure may be threadably secured to said barrel.

30. The flashlight assembly of claim 21, wherein said closure includes an adapter for selectively securing the flashlight to other implements.

31. The flashlight assembly of claim 30, wherein said adapter comprises a socket in axial alignment with said barrel.

32. The flashlight assembly of claim 31, wherein said socket further includes internally peripheral threads for receiving a threaded pin of an implement.

33. The flashlight assembly of claim 30, further including a cap adapted to be placed over the adapter when the flashlight assembly is not used in combination with another implement.

34. The flashlight assembly of claim 33 wherein said socket further includes internally peripheral threads for receiving a threaded pin of an implement, and wherein said cap includes mated peripheral threads to be received in said socket.

35. The flashlight assembly of claim 33, the cap including a storage means and a spare light bulb stowed in said storage means.

36. The flashlight assembly of claim 21, the closure having an outer wall and an internal cavity for housing the switching element, the switching element further comprising a push button switch having an activator push button accessible through the wall of the closure, and an opening in the wall in communication with the activator push button, the opening including a flexible membrane cover which may be selectively moved into contact with the activator button.

37. The flashlight assembly of claim 36, the wall including a continuous channel in communication with the opening and the cover including a retaining lip adapted to be received in the channel, the retaining lip conformed to form a moisture barrier between the cover and the wall.

38. The flashlight assembly of claim 37, the lip in the shape of an o-ring.

39. The flashlight assembly of claim 21, the switch element comprising a silent action push button switch.

40. The flashlight assembly of claim 39, the switch element push button including a first activated position wherein the switch is in an intermittent on position whenever the button is depressed to a first level of engagement and a second, full on position whenever the button is depressed to and locked in a second level engagement.

41. The flashlight assembly of claim 21, wherein the switch element includes a redundant backup circuit whereby the switch will continue to operate in the event of failure of either of two switching circuits.

42. A flashlight of the type having an elongated barrel with opposite ends, the barrel housing a power source, the barrel further having a head section attached at one end, the head section having a light bulb disposed therein, the flashlight further including a switching circuit for activating the light bulb, wherein the light bulb, the switching circuit and the power source form an electrical circuit, the flashlight assembly further comprising:

a first printed circuit board having a first side and a second side, wherein the switching circuit is mounted on the printed circuit board, the switching circuit including a first and a second electrode defined on the first side of the board, and a third and a fourth electrode defined on the second side of the board, the printed circuit board and the electrodes being disposed in the electrical circuit.

43. The flashlight of claim 42 wherein the first electrode is arranged about the center of the printed circuit board.

44. The flashlight of claim 42 wherein the second electrode is arranged about the circumference of the printed circuit board.

45. The flashlight of claim 42 wherein the third electrode is arranged about the center of the printed circuit board.

46. The flashlight of claim 42 wherein the fourth electrode is arranged about the circumference of the printed circuit board.

47. The flashlight of claim 42 wherein the negative side of the electrical circuit passes through the center of the printed circuit board.

48. The flashlight of claim 42 further comprising a second printed circuit board positioned substantially orthogonally to the first printed circuit board.

* * * * *

UNITED STATES PATENT AND TRADEMARK OFFICE

CERTIFICATE OF CORRECTION

PATENT NO. : 6,283,609 B1
DATED : September 4, 2001
INVENTOR(S) : Kevin L. Parsons, Donald A. Keller and Clay C. Reeves It is certified that error appears in the above-identified patent and that said Letters Patent is hereby corrected as shown below:

Column 17,
Line 33, after the word "flashlight" and before the word "further", insert -- assembly --

Signed and Sealed this

Fifth Day of March, 2002

*Attest:*

*Attesting Officer*

JAMES E. ROGAN
*Director of the United States Patent and Trademark Office*